US005106674A

United States Patent [19]

Okada et al.

[11] Patent Number: 5,106,674

[45] Date of Patent: Apr. 21, 1992

[54] BLADE MEMBER OF TUNGSTEN-CARBIDE-BASED CEMENTED CARBIDE FOR CUTTING TOOLS AND PROCESS FOR PRODUCING SAME

[75] Inventors: Yoshikazu Okada, Tokyo; Jun Sugawara, Yokohama, both of Japan

[73] Assignee: Mitsubishi Materials Corporation, Tokyo, Japan

[21] Appl. No.: 429,713

[22] Filed: Oct. 31, 1989

[30] Foreign Application Priority Data

Oct. 31, 1988 [JP] Japan ..... 63-275412

[51] Int. Cl.[5] ..... B32B 9/00

[52] U.S. Cl. ..... 428/217; 51/295; 51/307; 51/309; 76/DIG. 11; 407/119; 428/408; 428/457; 428/469; 428/697; 428/698

[58] Field of Search ..... 428/408, 698, 697, 457, 428/217, 469, 472; 76/DIG. 11; 407/119; 51/295, 307, 309; 75/240, 242

[56] References Cited

U.S. PATENT DOCUMENTS 4,359,335 11/1982 Garner ..... 51/309
4,642,003 2/1987 Yoshimura ..... 407/119
4,698,266 10/1987 Buljan et al. ..... 428/698

FOREIGN PATENT DOCUMENTS 52-110209 9/1977 Japan .
53-131909 11/1978 Japan .
0073392 6/1979 Japan .
0031507 3/1980 Japan .
0083517 6/1980 Japan .
6152541 11/1981 Japan .
0192259 11/1982 Japan .
0025605 2/1985 Japan .
61-34103 2/1986 Japan .
1183310 7/1989 Japan .

*Primary Examiner*—Patrick J. Ryan
*Assistant Examiner*—Archene Turner
*Attorney, Agent, or Firm*—Scully, Scott, Murphy & Presser

[57] ABSTRACT

A blade member of tungsten carbide based cemented carbide for cutting tools has a tungsten carbide based cemented carbide substrate having a hard phase, a binder phase and unavoidable impurities. The hard phase has 5% to 60% by weight of one or more of carbide and carbo-nitride of titanium, tantalum and tungsten, and carbide and carbonitride of titanium, tantalum, niobium and tungsten. The binder phase has 3% to 10% by weight of cobalt and a balance tungsten carbide. The substrate has a surface softening layer having a cobalt-pool phase and an interior portion. The surface softening layer has an outermost region in which hardness is generally constant with respect to depth from the substrate surface and an inner region in which hardness rises inwardly of the substrate up to the hardness of the interior portion. There is also disclosed a process for producing the above-mentioned blade member.

10 Claims, 4 Drawing Sheets

BLADE MEMBER OF TUNGSTEN-CARBIDE-BASED CEMENTED CARBIDE FOR CUTTING TOOLS AND PROCESS FOR PRODUCING SAME

BACKGROUND OF THE INVENTION

1. Field of the Invention

This invention relates to a blade member of tungsten carbide (WC) based cemented carbide for cutting tools, which has a superior heat plastic deformation resistance and, accordingly, which displays superior cutting performance for a long period of time when the blade member is used for high-speed cutting accompanied with high heat-generation at the cutting edge, and heavy duty cutting such as high-feed cutting and deep cutting.

2. Prior Art

Japanese Patent Unexamined Publication Nos. 52-110209 based cemented carbide having a WC-based cemented carbide substrate and a hard coating deposited thereon. The cemented carbide substrate has the following composition in terms of weight % (hereinafter % indicates % by weight):

one, or two or more of cobalt (Co), nickel (Ni) and iron (Fe) as a binder-phase forming component: 5% to 15%, one or more of carbides, nitrides and carbo-nitrides of metals in Groups $IV_A$, $V_A$ and $VI_A$ of the Periodic Table, as a dispersed-phase forming component: 5% to 40%, and the remainder: WC and unavoidable impurities.

The surface portion of the cemented-carbide substrate includes a surface softening layer in which a Co-pool phase is formed. The hard coating is formed by the use of a standard chemical vapor deposition method or physical vapor deposition method, and comprises a single layer of one of, or a plurality of layers of two or more of carbides, nitrides, carbo-nitrides, boro-nitrides, oxy-carbides, oxy-nitrides and oxy-carbo-nitrides of the same metals in Groups $IV_A$, $V_A$ and $VI_A$ as well as aluminum (Al) oxides, having an average layer thickness of 2 $\mu$m to 20 $\mu$m.

In the surface-coated blade member of WC-based cemented carbide, as disclosed in Japanese Patent Unexamined Application No. 53-131909, the cemented carbide substrate is manufactured by heat treatment of a vacuum-sintered body, in a carburizing atmosphere of $CH_4+H_2$ maintained at a temperature of no less than 1,400° C. for a predetermined period of time. Further, as disclosed in Japanese Patent Unexamined Application No. 61-34103, the WC-based cemented carbide substrate may be manufactured by sintering under conditions wherein after maintaining the body at a temperature of no less than 1,400° C. in a vacuum of no greater than $10^{-1}$ torr for a predetermined period of time, the atmosphere is switched to the above-described carburizing atmosphere, and the body is cooled from the sintering-completion temperature to a predetermined temperature at a temperature gradient of 0.5° C./min to 2.5° C./min. These substrates are produced by subjecting the ones which are once sintered to treatment in a carburizing atmosphere, and a WC-skeleton is firmly formed by means of sintering. Therefore, with the subsequent treatment in the carburizing atmosphere, there is formed a surface softening layer in which hardness and Co content exhibits a moderate change from the substrate surface inwardly of the substrate, and the Co-pool phase in the surface softening layer presents a form of dispersed lumps.

In cases where the conventional surface-coated blade member made of WC-based cemented carbide is used, particularly for cutting such as high-speed cutting accompanied with high heat generation at the cutting edge, or heavy duty cutting with high feed cutting and deep cutting, plastic deformation occur within a relatively short period of time, terminating the tool life of the blade member.

SUMMARY OF THE INVENTION

It is therefore an object of the present invention to provide a blade member of WC-based cemented carbide which is particularly superior in heat plastic deformation resistance.

Another object of the invention is to provide a process for producing the aforesaid blade member.

According to a first aspect of the invention, there is provided a blade member of tungsten carbide based cemented carbide for cutting tools, comprising a tungsten carbide based cemented carbide substrate consisting of a hard dispersed phase of 5% to 60% by weight of at least one compound selected from the group consisting of carbide and carbo-nitride of titanium, tantalum and tungsten, and carbide and carbo-nitride of titanium, tantalum, niobium and tungsten, a binder phase of 3% to 10% by weight of cobalt and a balance tungsten carbide, and unavoidable impurities; the substrate being comprised of a surface softening layer and an interior portion, the surface softening layer having a cobalt-pool phase and being comprised of an outermost region in which hardness is generally constant with respect to a depth from the substrate surface and an inner region in which hardness rises inwardly of the substrate up to the hardness of the interio portion.

According to a second aspect of the present invention, there is provided a process for producing the above-mentioned blade member, comprising the steps of: blending cobalt powder with tungsten carbide powder and powder of at least one compound selected from the group consisting of carbide and carbo-nitride of titanium, tantalum and tungsten and carbide and carbo-nitride of titanium, tantalum, niobium and tungsten, to provide a green compact; and sintering the green compact at a temperature of from 1,280° C. to 1,380° C. within a carburizing atmosphere in which the pressure is 0.1 torr to 10 torr, in such a manner that sintering starting temperature is higher than sintering completion temperature and that the sintering temperature decreases at a temperature gradient of 0.2° C./min to 2° C./min.

DETAILED DESCRIPTION OF THE INVENTION

A surface-coated blade member made of WC-based cemented carbide in accordance with the present invention comprises a WC-based cemented carbide substrate and a hard coating having an average layer thickness of 2 μm to 20 μm and deposited on the substrate. The hard coating is formed by a chemical vapor deposition method or a physical vapor deposition method, and is comprised of a single or a plurality of hard coating layers of a compound of at least one metal element, selected from the group consisting of elements of Groups $IV_A$, $V_A$ and $VI_A$ of the Periodic Table and aluminum and silicon (Si), and at least one non-metal element, selected from the group consisting of boron (B), carbon, nitrogen and oxygen.

Th WC-based cemented carbide substrate has the following composition:

Co as a binder-phase forming component: 3% to 10%, any one of a carbide and a carbo-nitride of titanium (Ti), tantalum (Ta) and W as well as a carbide and a carbonitride of Ti, Ta, niobium (Nb) and W (hereinafter referred to respectively as (Ti, Ta, W)C, (Ti, Ta, W)CN, (Ti, Ta, Nb, W)C and (Ti, Ta, Nb, W)CN, these being synthetically indicated by [Ti, Ta, (Nb), W]C N), as a dispersed-phase forming component: 5% to 60%, and the remainder: WC as the same dispersed-phase forming component and unavoidable impurities.

The substrate is comprised of a surface portion which serves as a surface softening layer and an interior portion. The surface portion has an outermost region in which the hardness is relatively low and change in hardness with respect to the depth from the substrate surface is generally constant or gradual toward the interior from the surface, and a second region in which the hardness rises abruptly up to the high hardness level of the interior portion. Furthermore, that layer of the hard coating deposited directly on the surface of the substrate is made of any one of titanium carbide, titanium nitride and titanium carbonitride.

In the above-mentioned blade member, the Co component has an action that increases the toughness of the substrate. However, the Co component cannot secure a desired toughness if the content of the Co component is less than 3%, and cannot bring the distribution of the Co-pool phase in the surface softening layer to a desired state. Or the other hand, if the content of the Co component exceeds 10%, wear resistance of the substrate decreases. Accordingly, the content of the Co component is limited to 3% to 10%. Furthermore, the [Ti, Ta, (Nb), W]C·N component not only gives an improvement in wear resistance of the substrate, but also is essential for forming a desired Co-pool phase distribution in the surface softening layer under a suitable sintering condition. If the [Ti, Ta, (Nb), W]C·N is less than 5%, however, it is impossible to obtain the desired functional advantages of the aforementioned action. If the content exceeds 60%, toughness of the substrate decreases. Thus, the content is set at from 5% to 60%.

Figure 1:
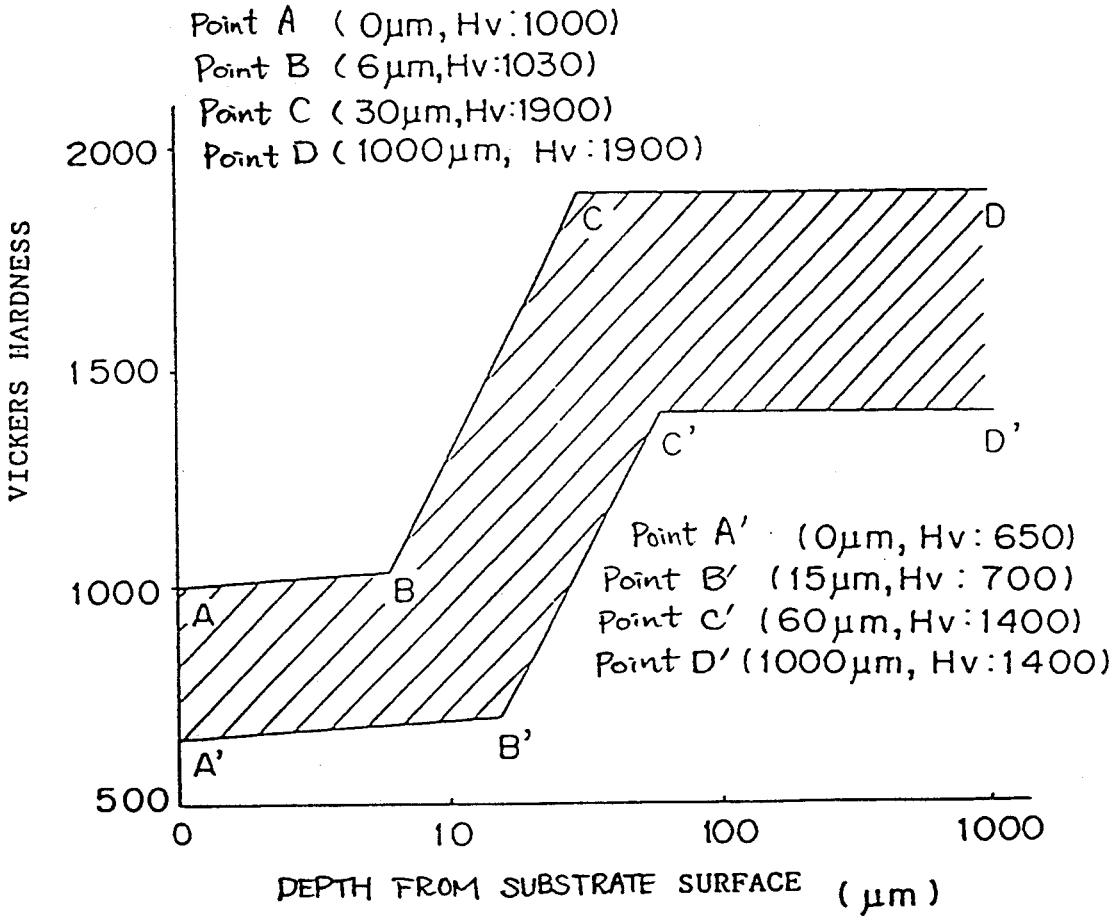
FIG. 1 is a view showing a relationship between a depth from a substrate surface and the Vickers hardness.

From the viewpoint of an improvement in heat plastic deformation resistance, it is preferable that, in the relationship between the depth from the substrate surface and the Vickers hardness shown in FIG. 1, the above-mentioned regions in the substrate surface portion has a hardness distribution within a range enclosed by an upper-limit line connecting points A, B, C and D shown in FIG. 1 to each other and a lower-limit line connecting points A', B', C' and D' to each other.

Figure 2:
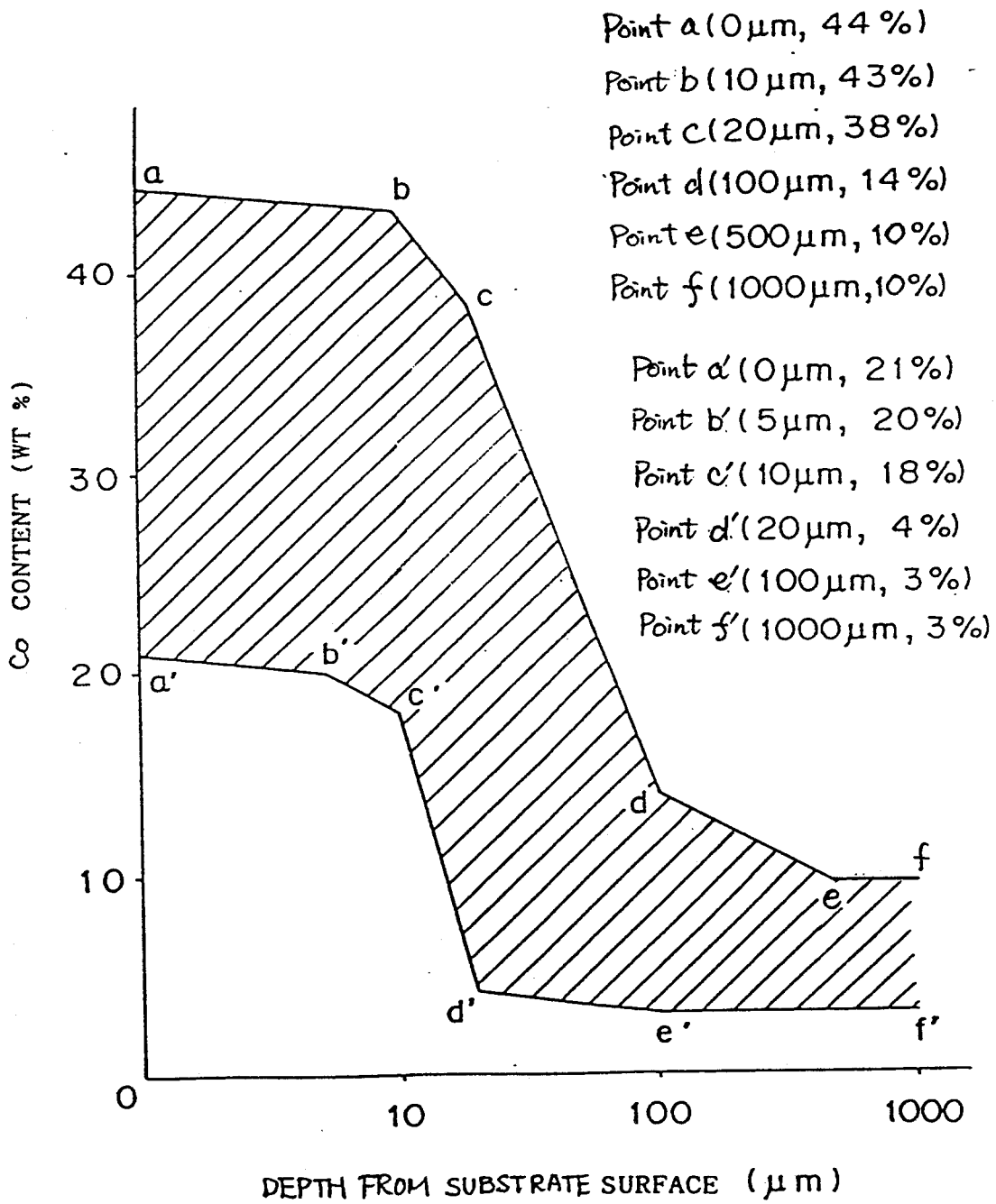
FIG. 2 is a view showing a relationship between a depth from the substrate surface and Co content.

Moreover, for a similar reason, the Co content in the surface portion of the substrate is adjusted according to the relationship between the depth from the substrate surface and the Co content shown in FIG. 2, such that an outermost region in which the Co content is extremely high relatively and a change in the Co content is generally constant or gradual toward the interior from the surface, and an inner region in which the Co content abruptly decreases successively to the interior Co content level, are present. Preferably, the Co content should have a Co-content distribution within a range encircled by an upper-limit line connecting points a, b, c, d, e and f to each other, and a lower-limit line connecting a', b', c', d', e' and f' to each other.

Furthermore, in a preferred blade member according to the present invention, the percentage of hardness of the surface portion with respect to the hardness of the interior portion of the substrate is 30% to 70%, and more preferably, 30% to 50%. Moreover, the percentage of Co content of the surface portion with respect to the Co content of the interior portion of the substrate is 300% to 800%, and more preferably, 500% to 800%. In a preferred blade member which satisfies these conditions, the configuration of the Co-pool phase in the surface softening layer is in the form of a laterally spread plate-like layer, and it is observed that the heat plastic deformation resistance is further improved.

On the contrary, if the hardness percentage is less than 30%, or the hardness percentage exceeds 70%, and further if the Co content percentage is less than 300% or the Co percentage exceeds 800%, the configuration of the Co-pool phase does not form as a laterally spread plate-like layer.

A manufacturing method of a blade member of cemented carbide according to the present invention involves blending WC and any one of [Ti, Ta, (Nb), W]C·N, in the form of a simple powder, a composite solid-solution powder, or both, with Co to provide a green compact, and sintering the green compact at a temperature of from 1,280° C. to 1,380° C., which centers around a solid-phase and liquid-phase coexistence region of the binder phase, within a carburizing atmosphere of $CH_4$ or $CH_4$ and $H_2$ in which the pressure is 0.1 torr to 10 torr, in such a manner that the sintering starting temperature is above the sintering completion temperature, and that the temperature falls at a temperature gradient of 0.2° C./min to 2° C./min.

The sintering conditions referred to above are determined empirically. If any of the atmospheric pressure, the sintering temperature and the temperature gradient conditions is out of the respective aforesaid ranges, it is impossible to obtain the aforementioned blade member according to the present invention.

Subsequently, a hard coating is deposited on the surface of the WC-based cemented-carbide substrate of the invention using the standard chemical vapor deposition method or physical vapor deposition method, wherein the first layer formed directly on the substrate surface is limited to any one of titanium carbide, titanium nitride and titanium carbide-nitride. By such selection of compounds, adhesiveness of the hard coating with respect to the substrate surface is improved. In addition, if one or more layers containing $Al_2O_3$ are formed on the above first layer, the wear resistance of the blade member is further improved.

Furthermore, the substrate of the blade member of the invention contains precipitates of free carbon in that portion spaced at least 100 μm from the substrate surface.

As described above, the blade member of WC-based cemented carbide for cutting tools in accordance with the present invention has a predetermined hardness distribution given by the Co-pool phase in the surface softening layer formed in the substrate surface, thereby making. The blade member superior in heat plastic deformation resistance. Accordingly, in the case where the blade member is used in cutting tools for high-speed cutting accompanied with high heat generation at the cutting edge, or heavy duty cutting such as high feed cutting, deep cutting or the like, the cutting tools have useful industrial characteristics such as providing superior cutting performance for extended periods.

The blade member of WC-based cemented carbide for cutting tools in accordance with the present invention and the process for producing the same will next be described in detail by way of an example.

EXAMPLE

The following methods 1 through 7 and the following comparative methods 1' through 4' were followed. That there were prepared raw-material powders of $(Ti_{0.71}W_{0.29})(C_{0.69}N_{0.31})$ powder, $(Ta_{0.83}Nb_{0.17})C$ powder, $(Ti_{0.32}Ta_{0.15}Nb_{0.18}W_{0.35})C$ powder, $(Ti_{0.58}W_{0.42})C$ powder, TiC powder, TiN powder, TaC powder, NbC powder and $(Ti_{0.39}Ta_{0.20}W_{0.41})C$ powder, each having an average particle size of 1 μm, as well as WC powder with an average particle size of 3.5 μm and Co powder with an average particle size of 1.2 μm. These raw-material powders were blended with each other into the compositions given in Table 1. After wet-mixing the raw material powders together for 72 hours in a ball mill and drying, the powders were pressed under a pressure of 10 kg/mm$^2$ into green compacts, each having a configuration in conformity with SNMG 120408 of the ISO standards. Subsequently, the green compacts were sintered under the conditions indicated in Table 1. In the comparative methods 1' and 2', the green compacts were heat-treated separately after vacuum sintering, under the following conditions: ambient pressure: 100 torr, ambient gas composition: $CH_4+H_2$, heating temperature: 1,430° C., retaining time: 30 minutes, and cooling: furnace cooling. WC-based cemented-carbide substrates were produced having a respective component composition, hardness and Co content of the interior portion of the surface portions as well as hardness and Co content of the outermost regions of the surface portions of the surface softening layers as indicated in Tables 2 and 3. The substrates were then washed. While subjecting the substrates to a round honing of 0.06 mm, hard coatings were formed, respectively, which had a composition and average layer thickness as indicated in Table 3. The surface-coated cutting inserts 1 through 7 made of WC-based cemented carbide according t the present invention (hereinafter referred to as "cutting inserts according to the invention") and comparative surface-coated cutting inserts 1' through 4' made of WC-based cemented carbide (hereinafter referred to as "comparative cutting inserts") were all manufactured in this way.

In the foregoing, the comparative cutting inserts 1' through 4' were manufactured respectively by the comparative methods 1' through 4' under conventional sintering conditions.

From the various cutting inserts obtained as a result of the above manufacturing methods, an investigation of the hardness distribution and the Co-content distribution on the cutting inserts 1, 4 and 6 according to the present invention and the comparative cutting inserts 2' and 4' was made. The investigation gave the results shown in FIGS. 3 and 4. The hardness percentage and the Co content percentage were also investigated for each cutting insert and the results are set forth in Table 2. The hardness shown in FIG. 3 was based on micro Vickers (load: 200 g) measurements on an inclined surface having an angle of 10°. Further, the Co content in FIG. 4 was based on measurement by EPMA at cross sections of the inserts.

Figure 3:
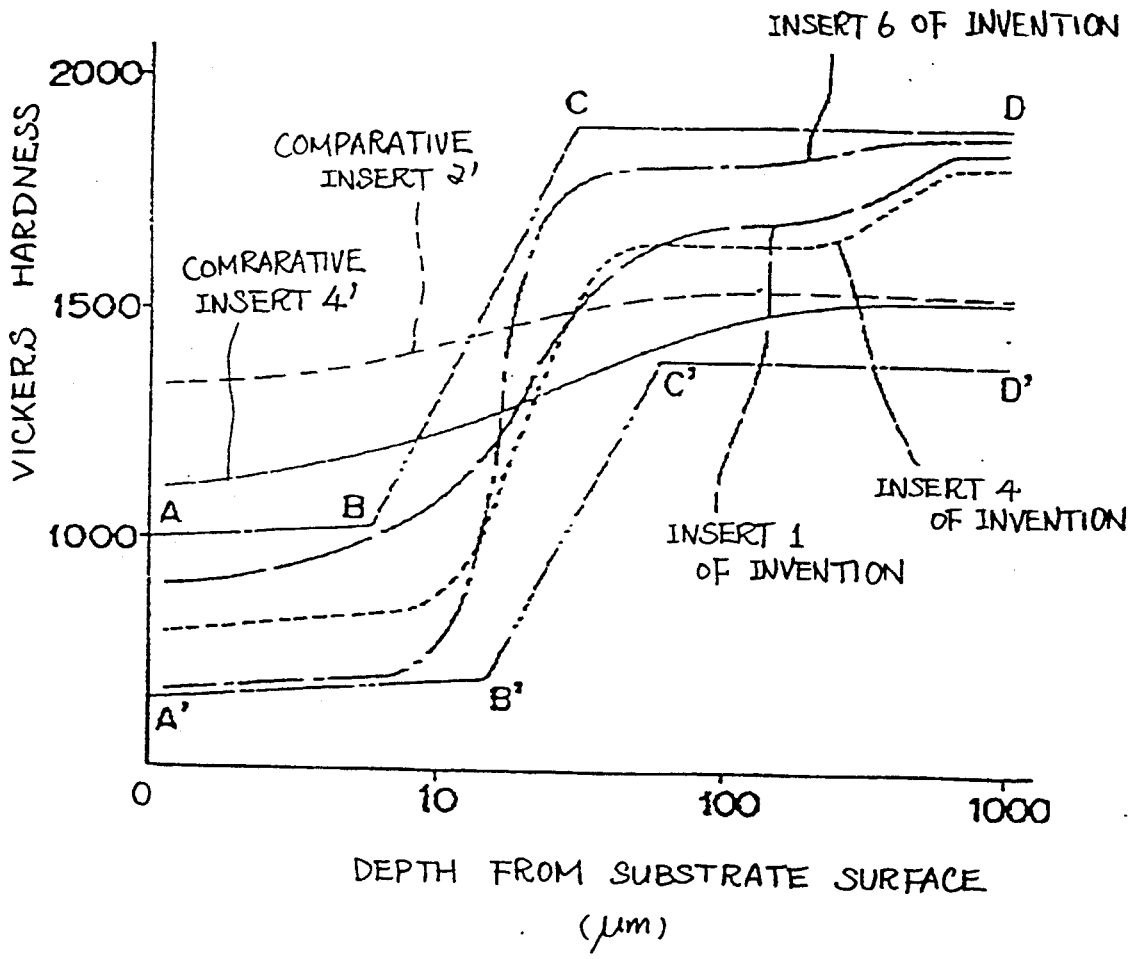
FIG. 3 is a view showing hardness distribution curves for substrate surface softening layers for various coated cutting inserts.
Figure 4:
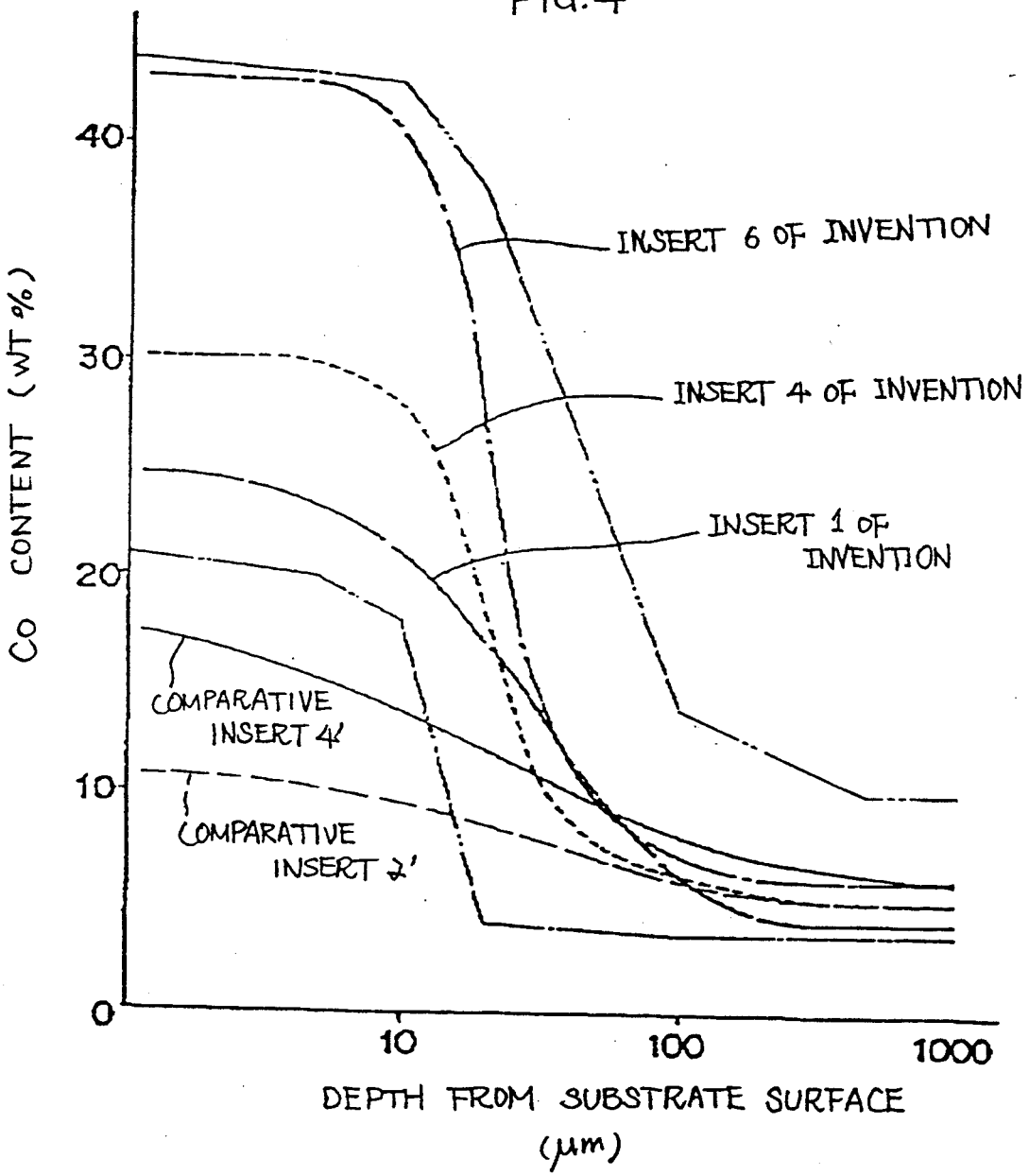
FIG. 4 is a view showing Co-content distribution curves for the surface softening layers of the abovementioned cutting inserts.

From the results given in Tables 2 and 3 and shown in FIGS. 3 and 4, the cutting inserts 1 through 7 according to the invention had hardness percentages and Co-content percentages in the WC-based cemented carbide substrate within the respective ranges of from 30% to 70% and from 300% to 800%, and the cuting inserts had hardness distributions and the Co-content distributions within the respective ranges shown in FIGS. 3 and 4, respectively. In contrast, it will be seen that for any of the comparative cutting inserts the hardness percentages and the Co-content percentages of the cemented-carbide substrate deviate from the above-described respective ranges, and the hardness distributions and the Co-content distributions also deviate from the ranges shown in FIGS. 3 and 4.

Cross sections of the surface softening layer of each of the aforesaid cutting inserts were observed under a metallurgical microscope revealing that, for any of the cutting inserts 1 through 7 according to the present invention, a Co-pool phase presenting a laterally spread plate-like layer parallel to the substrate surface was present. However, for the comparative cutting inserts 1' through 4' the structure was such that the Co-pool phase was dispersed in the form of lumps.

The following experiments were conduced on the various cutting inserts.

Dry-type continuous high-speed cutting test with steel under the following conditions:

Workpiece: round bar of alloy steel (JIS. S45C; Brinnell hardness: 240)
Cutting speed: 280 m/minute
Feed rate: 0.2 mm/revolution
Depth of cut: 3 mm Dry-type continuous high-feed cutting test with steel under the following conditions:

Workpiece: round bar of alloy steel (JIS. SNCM 439; Brinell hardness: 350)
Cutting speed: 120 m/minute
Feed rate: 0.95 mm/revolution
depth of cut: 3 mm Dry-type continuous high-volume cutting test with steel under the following conditions:

Workpiece: round bar of alloy steel (JIS. SNCM 439; Brinell hardness: 270)
Cutting Speed: 180 m/minute
Feed rate: 0.4 mm/revolution
Depth of cut: 7 mm Cutting time in the experiments was measured, as the time to reach a flank wear width of a cutting edge of 0.4 mm. The results of the measurement are also set forth in Table 2.

From the results given in Table 2, all of the cutting inserts 1 through 7 according to the present invention showed superior cutting performance for a long period of time during which plastic deformation did not occur in the cutting edge for any of the cutting conditions of high-speed cutting accompanied with high heat generation in the cutting edge, high-feed cutting, and deep cutting. In contrast, the condition of the comparative cutting inserts 1' through 4' was such that at least some of the above conditions indicated by * in Table 2 were out of the ranges of the present invention, showing that the inserts reached their service lives after a relatively short period of time with the occurrence of plastic deformation.

TABLE 1

| Kind of process | | Blend composition of substrate (wt %) Co | [Ti,Ta,(Nb),W]C.N | WC | Sintering conditions: Ambient pressure (torr) | Ambient gas composition | Sintering start temp. (°C.) | Sintering completion temp. (°C.) | Temperature gradient during sintering (°C./min) | Holding time (min) | Cooling condition |
|---|---|---|---|---|---|---|---|---|---|---|---|
| Process of invention | 1 | 4 | (Ti,W)CN:4.6, (Ta,Nb)C:3 | Other | 10 | $CH_4$ | 1380 | 1300 | 2 | 40 | furnace cooling |
| | 2 | 5 | (Ti,Ta,Nb,W)C:14 | Other | 7 | $CH_4$ +1370 | 1280 | 1.5 | 60 | | - |
| | 3 | 5 | TiC:4.6,TiN:2.4, TaC:10.6 | Other | 4 | $H_2$ | 1360 | 1300 | 1 | | |
| | 4 | 5 | (Ti,W)C:20.3, NbC:2.5, (Ta,Nb)C:5 | Other | 1 | | 1350 | 1320 | 0.5 | | |
| | 5 | 5 | TiC:7.2,TaC:12.9, NbC:1.4 | Other | 0.6 | | 1340 | 1316 | 0.4 | | |
| | 6 | 6 | (Ti,Ta,W)C:58 | Other | 0.1 | $CH_4$ | 1330 | 1318 | 0.2 | | |
| | 7 | 9 | (Ti,Ta,W)C:6 | Other | 10 | | 1380 | 1320 | 2 | 30 | |
| Comparative process | 1' | 4 | (Ti,W)CN:4.6, (Ta,Nb)C:3 | Other | 0.05 | Vacuum | 1450 | 1450 | — | 60 | heat-treated separately after furnace cooling |
| | 2' | 5 | (Ti,W)C:20.3, NbC:2.5 (Ta,Nb)C:5 | Other | | | | | | | |
| | 3' | 5 | TiC:4.6,TiN:2.4, TaC:10.6 | Other | 0.03 | Vacuum | 1450 | 1450 | | | furnace cooling after the cooling at 2° C./min to 1200° C. in a carburizing $CH_4$ atmosphere of 1 torr |
| | 4' | 6 | (Ti,Ta,W)C:58 | Other | | | | | | | |

TABLE 2

| Kind of cutting inserts | | Composition of substrate (wt %) Co | [Ti,Ta,(Nb),W]C.N | WC | Hardness (Vickers hardness): Interior portion | Surface softening layer | Percentage | Co content (wt %): Interior portion | Surface softening layer | Percentage |
|---|---|---|---|---|---|---|---|---|---|---|
| Cutting inserts of the invention | 1 | 4 | (Ti,Ta,Nb,W)CN:9 | Other | 1850 | 900 | 48.7 | 4 | 24.8 | 620 |
| | 2 | 5 | (Ti,Ta,Nb,W)C:14 | Other | 1700 | 840 | 49.4 | 5 | 26.4 | 528 |
| | 3 | 5 | (Ti,Ta,W)CN:27 | Other | 1800 | 820 | 45.6 | 5 | 28.6 | 572 |
| | 4 | 5 | (Ti,Ta,Nb,W)C:35 | Other | 1820 | 790 | 43.4 | 5 | 30.2 | 604 |
| | 5 | 5 | (Ti,Ta,Nb,W)C:46 | Other | 1870 | 720 | 38.5 | 5 | 38.5 | 770 |
| | 6 | 6 | (Ti,Ta,W)C:58 | Other | 1880 | 670 | 35.6 | 6 | 43.1 | 718 |
| | 7 | 9 | (Ti,Ta,W)C:6 | Other | 1430 | 995 | 69.6 | 9 | 28.1 | 312 |
| Comparative cutting inserts | 1' | 4 | (Ti,Ta,Nb,W)CN:9 | Other | 1580 | 1390 | *88.0 | 4 | 8.1 | *203 |
| | 2' | 5 | (Ti,Ta,Nb,W)C:35 | Other | 1540 | 1330 | *86.4 | 5 | 10.9 | *218 |
| | 3' | 5 | (Ti,Ta,W)CN:27 | Other | 1590 | 1210 | *76.1 | 5 | 12.7 | *254 |
| | 4' | 6 | (Ti,Ta,W)C:58 | Other | 1530 | 1110 | *72.5 | 6 | 17.5 | *292 |

*denotes values out of the preferred ranges of the invention.

TABLE 3

| Kind of cutting inserts | | Composition of hard coating & average thickness (μm): 1st layer | 2nd layer | 3rd layer | 4th layer | 5th layer | 6th layer | High-speed cutting time (min) | High-feed cutting time (min) | Deep cutting time (min) |
|---|---|---|---|---|---|---|---|---|---|---|
| Cutting inserts of the invention | 1 | TiC:4 | TiBN:1 | $Al_2O_3$:3 | — | — | — | 44 | 25.6 | 67 |
| | 2 | TiN:0.5 | TiCN:0.5 | TiC:3 | TiCO:1 | $Al_2O_3$:3 | — | 41 | 23.5 | 63 |
| | 3 | TiC:3 | TiCN:2 | TiNO:1 | $Al_2O_3$:2 | — | — | 39 | 20.1 | 57 |
| | 4 | TiC:1 | TiCN:1 | TiC:3 | TiCNO:0.5 | $Al_2O_3$:2 | TiN:0.5 | 36 | 19.2 | 52 |
| | 5 | TiC:3 | TiCN:3 | TiN:2 | — | — | — | 33 | 17.5 | 43 |
| | 6 | TiCN:8 | — | — | — | — | — | 31 | 16.3 | 40 |
| | 7 | TiC:8 | — | — | — | — | — | 24 | 13.7 | 31 |
| Comparative cutting | 1' | TiC:4 | TiBN:1 | $Al_2O_3$:3 | — | — | — | #9 | #3.9 | #12 |
| | 2' | TiC:1 | TiCN:1 | TiC:3 | TiCNO:0.5 | $Al_2O_3$:2 | TiN:0.5 | #6 | #2.8 | #8 |
| | 3' | TiC:3 | TiCN:2 | TiNO:1 | $Al_2O_3$:2 | — | — | #18 | #9.3 | #23 |

TABLE 3-continued

| Kind of cutting inserts | | Composition of hard coating & average thickness (μm) 1st layer | 2nd layer | 3rd layer | 4th layer | 5th layer | 6th layer | High-speed cutting time (min) | High-feed cutting time (min) | Deep cutting time (min) |
|---|---|---|---|---|---|---|---|---|---|---|
| inserts | 4' | TiCN:8 | — | — | — | — | — | #15 | #8.6 | #21 |

#denotes the occurrence of plastic deformation

What is claimed is:

1. A blade member of tungsten carbide based cemented carbide for cutting tools, comprising a tungsten carbide based cemented carbide substrate consisting of a hard dispersed phase of 5% to 60% by weight of at least one compound selected from the group consisting of carbide and carbo-nitride of titanium, tantalum and tungsten, and carbide and carbo-nitride of titanium, tantalum, niobium and tungsten, a binder phase of 3% to 10% by weight of cobalt and a balance tungsten carbide, and unavoidable impurities; said substrate being comprised of a surface softening layer and an interior portion, aid surface softening layer having a cobalt-pool phase and being comprised of an outermost region in which hardness is generally constant with respect to a depth form the substrate surface an an inner region in which hardness rises inwardly of the substrate up to the hardness of said interior portion where in said cobalt-pool phase in said surface softening layer is distributed in a laterally spread form generally parallel to the substrate surface.

2. A blade member of tungsten carbide based cemented carbide according to claim 1, further comprising a hard coating of an average thickness of 2 μm to 20 μm deposited on the surface of said substrate, said hard coating being comprised of at least one layer of a compound of at least one metal element, selected from the group consisting of elements of Groups $IV_A$, $V_A$ and $VI_A$ of the Periodic Table and aluminum and silicon, and at least one non-metal element, selected from the group consisting of boron, carbon, nitrogen and oxygen.

3. A blade member of tungsten carbide based cemented carbide according to claim 2, wherein that layer of said hard coating formed in contact with the surface of said substrate is comprised of at least one compound selected from the group consisting of titanium carbide, titanium nitride and titanium carbo-nitride.

4. A blade member of tungsten carbide based cemented carbide according to claim 1, wherein said surface softening layer of said substrate is comprised of an outermost region in which cobalt content is generally constant with respect to the depth from the substrate surface and an inner region in which cobalt content decreases inwardly of the substrate up to the cobalt content of said interior portion.

5. A blade member of tungsten carbide based cemented carbide according to claim 1, wherein said surface softening layer has a hardness distribution within a range enclosed by an upper-limit line connecting points A, B, C and D to each other and a lower-limit line connecting points A', B', C' and D' to each other, in a figure of relationship between a depth from the substrate surface and the Vickers hardness shown in FIG. 1.

6. A blade member of tungsten carbide based cemented carbide according to claim 4, wherein said surface softening layer has a cobalt distribution within a range enclosed by an upper-limit line connecting points a, b, d, e and f to each other and a lower-limit line connecting points a', b', c', d', e' and f' to each other, in a figure of relationship between a depth from the substrate surface and the cobalt content shown in FIG. 2.

7. A blade member of tungsten carbide based cemented carbide according to claim 6, wherein the hardness of said surface softening layer is set so that a percentage of the hardness with respect to the hardness of said interior portion is from 30% to 70%, while the cobalt content of said surface softening layer is set so that a percentage of the cobalt content with respect to the cobalt content in said interior portion is from 300% to 800%.

8. A blade member of tungsten carbide based cemented carbide according to claim 1, wherein said substrate contains precipitates of free carbon in that portion spaced at least 100 μm from the substrate surface.

9. A blade member according to claim 1, produced by the steps of:

blending cobalt powder with tungsten carbide powder and a powder of at least one compound selected from the group consisting of a carbide and carbo-nitride of titanium, tantalum, tungsten, and a carbide and carbo-nitride of titanium, tantalum, niobium and tungsten; to provide a green compact; and sintering said green compact at a temperature of from 1,280° C. to 1,380° c. within a carburizing atmosphere in which the pressure is 0.1 torr to 10 torr, in such a manner that the sintering starting temperature is higher than the sintering completion temperature and that the temperature decreases at a temperature gradient of 0.2° C./min to 2° C./min.

10. A blade member according to claim 9, further comprising forming a hard coating of an average thickness of 2 μm to 20 μm on the substrate surface by a deposition method, said chard coating having at least one layer formed in contact with the surface of said substrate and comprises of at least one compound selected from the group consisting of titanium carbide, titanium nitride and titanium carbo-nitride.

* * * * *

UNITED STATES PATENT AND TRADEMARK OFFICE

CERTIFICATE OF CORRECTION

PATENT NO. : 5,106,674

DATED : April 21, 1992

INVENTOR(S) : Yoshikazu Okada, et al.

It is certified that error appears in the above-identified patent and that said Letters Patent is hereby corrected as shown below:

Column 1, line 20: "52-110209 based" should read as --52-110209 and 53-131909 describe a conventional blade member of WC-based--

Column 2, line 9: "occur" should read as --occurs--

Column 3, line 18: "Th" should read as --The--

Column 3, line 50: "Or" should read as --On--

Column 5, line 10: "making. The" should read as --making the--

Column 5, lines 25-26: "That there" should read as --That is, there--

Column 5, lines 26-27: "$(Ti_{0.71} W_{0.29})$" should read as --$(Ti_{0.71} W_{0.29})$--

Column 5, line 58: "t" should read as --to--

Column 6, line 39: "conduced" should read as --conducted--

Column 7, line 5: after "comparative" insert --cutting inserts 1' through 4' was such that at least some--

Column 8, line 17, Table 1: delete "+1370"

UNITED STATES PATENT AND TRADEMARK OFFICE

CERTIFICATE OF CORRECTION

PATENT NO. : 5,106,674

DATED : April 21, 1992

INVENTOR(S) : Yoshikazu Odaka, et al.

It is certified that error appears in the above-identified patent and that said Letters Patent is hereby corrected as shown below:

Column 8, line 16, Table 1: "1280" should read as --1370--

Column 8, line 16, Table 1: "1.5" should read as --1280--

Column 8, line 16, Table 1: "60" should read as --1.5--

Column 8, line 16, Table 1: after "1.5" insert --60--

Column 7, line 54: delete "cutting inserts 1' through 4' was such that at least some"

Column 9, line 22, Claim 1: "aid" should read as --said--

Column 9, line 25, Claim 1: "an an" should read as --and an--

Column 10, line 19, Claim 6: "b, d," should read as --b, c, d,--

UNITED STATES PATENT AND TRADEMARK OFFICE

CERTIFICATE OF CORRECTION

PATENT NO. : 5,106,674

DATED : April 21, 1992

INVENTOR(S) : Yoshikazu Odaka, et al.

It is certified that error appears in the above-identified patent and that said Letters Patent is hereby corrected as shown below:

Column 10, line 45, Claim 9: "1,380° c." should read as --1,380° C.--

Column 10, line 54, Claim 10: "chard" should read as --hard--

Column 10, line 56, Claim 10: "comprises" should read as --comprised--

Signed and Sealed this

Fourteenth Day of September, 1993

*Attest:*

*Attesting Officer*

BRUCE LEHMAN

*Commissioner of Patents and Trademarks*